US006389933B1

(12) United States Patent
Chen

(10) Patent No.: US 6,389,933 B1
(45) Date of Patent: May 21, 2002

(54) OPEN END WRENCH

(76) Inventor: Chyi hong Chen, No. 1 Alley 2, Lane 741 Tung-Ping Rd., Taiping City, Taichung Hsien (TW)

( * ) Notice: Subject to any disclaimer, the term of this patent is extended or adjusted under 35 U.S.C. 154(b) by 0 days.

(21) Appl. No.: 09/803,427

(22) Filed: Mar. 8, 2001

(51) Int. Cl.[7] ..... B25B 13/02
(52) U.S. Cl. ..... 81/119; 81/186
(58) Field of Search ..... 81/119, 186

(56) References Cited

U.S. PATENT DOCUMENTS 6,276,240 B1 * 8/2001 Blacklock ..... 81/119

* cited by examiner

*Primary Examiner*—James G. Smith
(74) *Attorney, Agent, or Firm*—Pro-Techtor International Services

(57) ABSTRACT

An open end wrench having a head comprises a first arm comprising a first, second, and third projections each having a first interior surface at one side and a second interior surface at the other side; and an opposite second arm comprising a first, second, and third flats. A first distance between the first flat and the first interior surface of the first projection is smaller than a second distance between the second flat and the first interior surface of the second projection, a third distance between the third flat and the first interior surface of the third projection is larger than the second distance between the second flat and the first interior surface of the second projection, and an angle θ is formed between one side of a held fastener and the second interior surface of one of the first, second, and third projections.

1 Claim, 4 Drawing Sheets

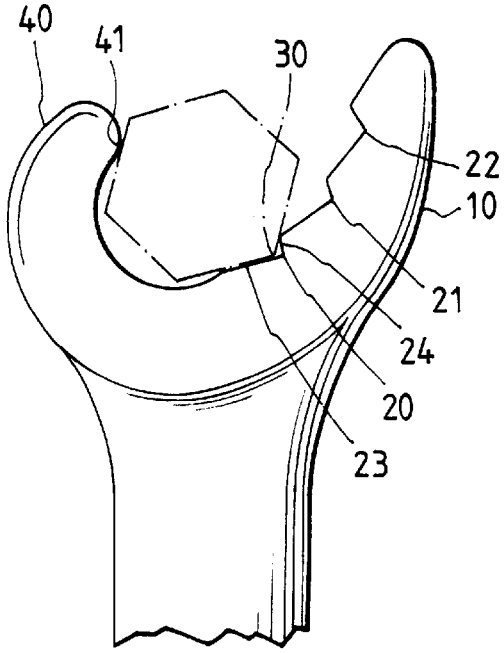
FIG,1
PRIOR ART
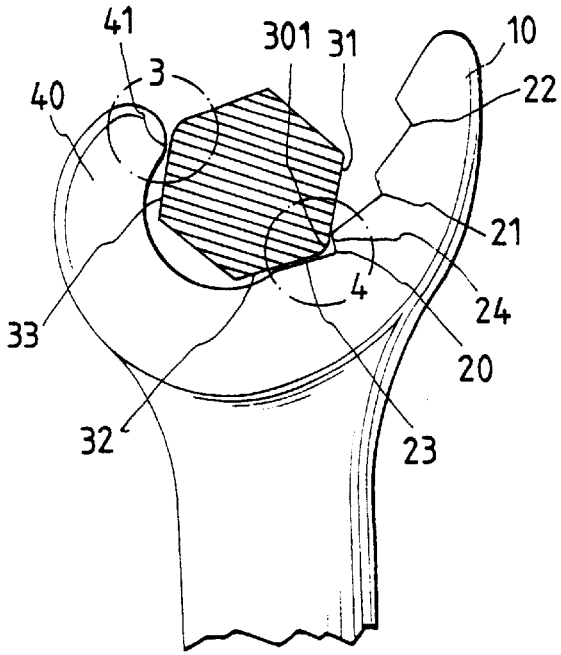
FIG,2
PRIOR ART
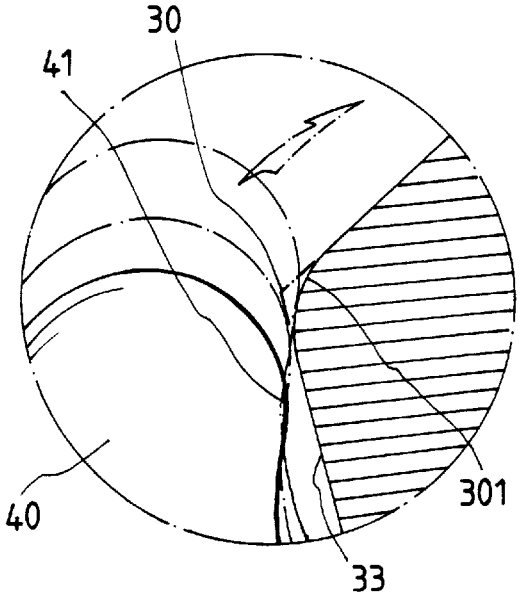
FIG,3
PRIOR ART
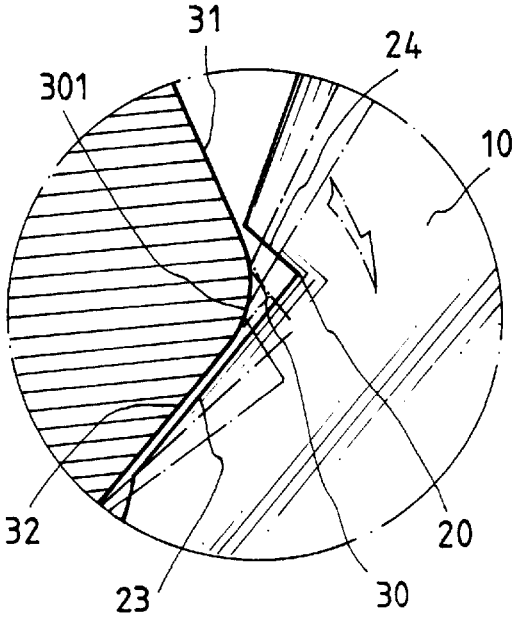
FIG,4
PRIOR ART

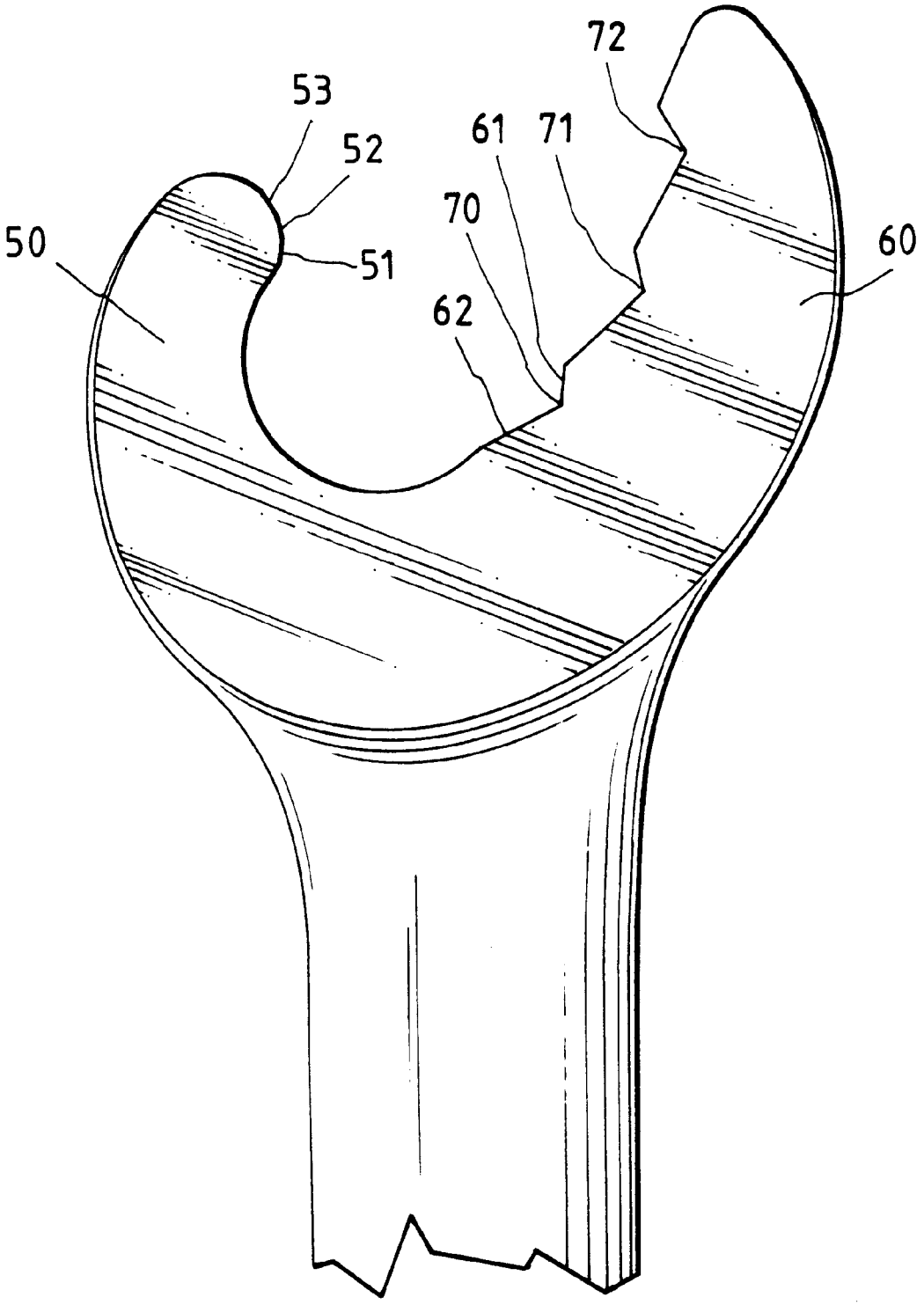
FIG, 5

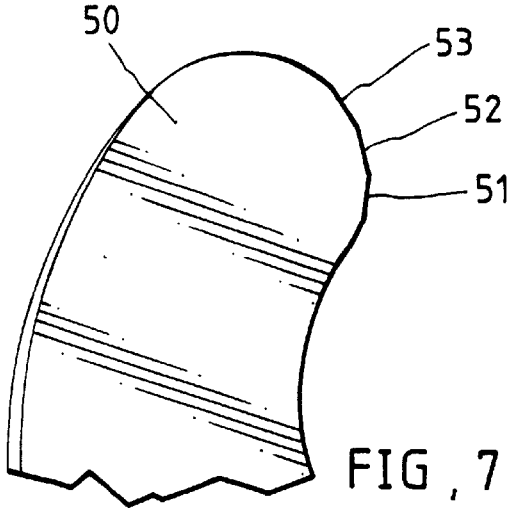
FIG, 7
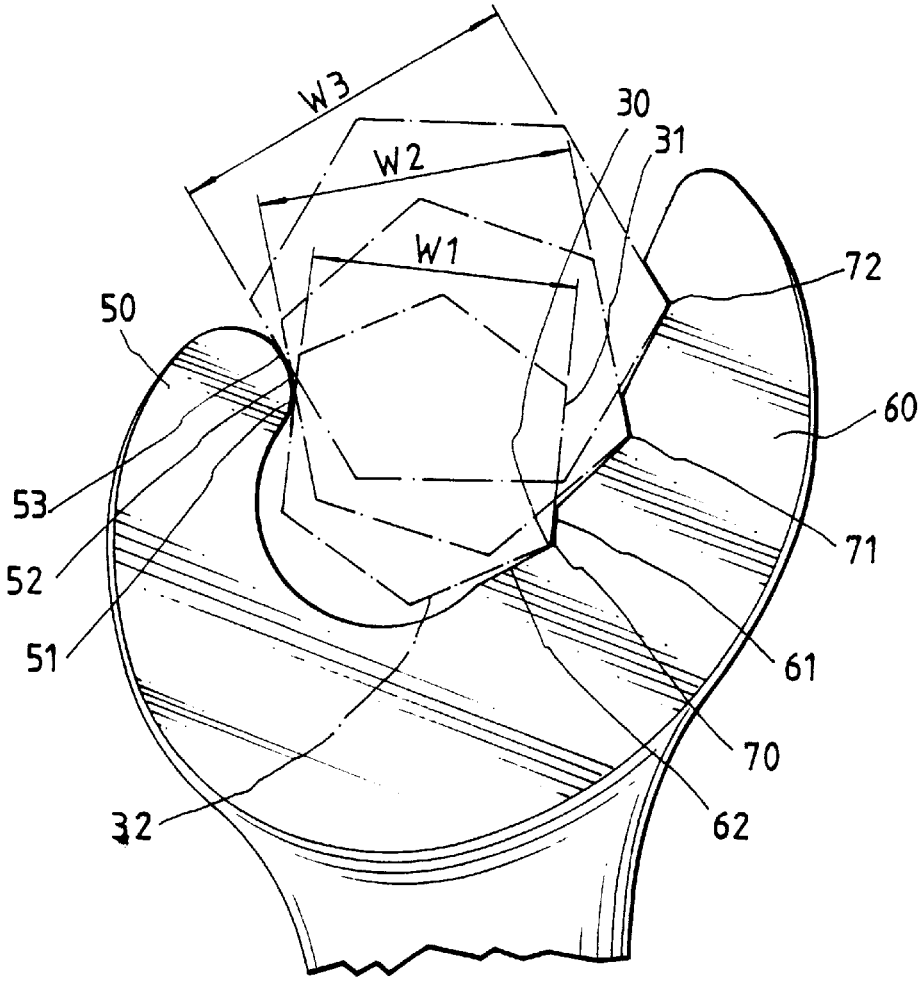
FIG, 6

OPEN END WRENCH

BACKGROUND OF THE INVENTION

1. Field of the Invention

The present invention relates to open end wrenches and more particularly to an open end wrench with improved holding characteristics.

2. Description of the Prior Art

Head of a conventional open end wrench is shown in FIGS. 1 to 4 comprising three projections 20, 21, and 22 at one arm 10 and an arcuate section 41 at the other opposite arm 40. Each of projections 20, 21, and 22 has a first interior surface 23 at one side and a second interior surface 24 at the other side. A hexagonal nut (or bolt head) engages with a point on arcuate section 41, first interior surface 23, and second interior surface 24. As shown in FIG. 3, only a point on arcuate section 41 is engaged with the arcuate portion 301 of angle 30 of nut. Further as shown in FIG. 4, only side 32 is engaged with the first interior surface 23 while side 31 is at a point contact with the first interior surface 24. In view of above, the engagement is not secure. Thus a slip may occur between wrench and nut when user holds and turns the nut by the wrench. Thus, improvement exists.

SUMMARY OF THE INVENTION

It is an object of the present invention to provide an open end wrench having a head comprising a first arm comprising a first, second, and third projections each having a first interior surface at one side and a second interior surface at the other side; and an opposite second arm comprising a first, second, and third flats. A first distance between the first flat and the first interior surface of the first projection is smaller than a second distance between the second flat and the first interior surface of the second projection, a third distance between the third flat and the first interior surface of the third projection is larger than the second distance between the second flat and the first interior surface of the second projection, and an angle θ is formed between one side of a held fastener and the second interior surface of one of the first, second, and third projections. By utilizing this, a fastener (e.g., nut) is secured when held by the wrench. Also, such small angle θ ensures torque to be completely transferred to nut while turning wrench. Hence, a slip between wrench and nut in operation as experienced in prior art is eliminated.

The above and other objects, features and advantages of the present invention will become apparent from the following detailed description taken with the accompanying drawings.

BRIEF DESCRIPTION OF THE DRAWINGS

FIGS. 1 and 2 are perspective views of a conventional open end wrench with a nut held therein respectively;

FIG. 3 is a detailed view of the area circle 3 in FIG. 2;

FIG. 4 is a detailed view of the area circle 4 in FIG. 2;

FIG. 5 is a perspective view of an open end wrench according to the invention;

FIG. 6 is a view similar to FIG. 5 where three different sized nuts held by wrench are plotted;

FIG. 7 is an enlarged view of one arm of FIG. 6; and

DETAILED DESCRIPTION OF THE PREFERRED EMBODIMENTS

Figure 8:
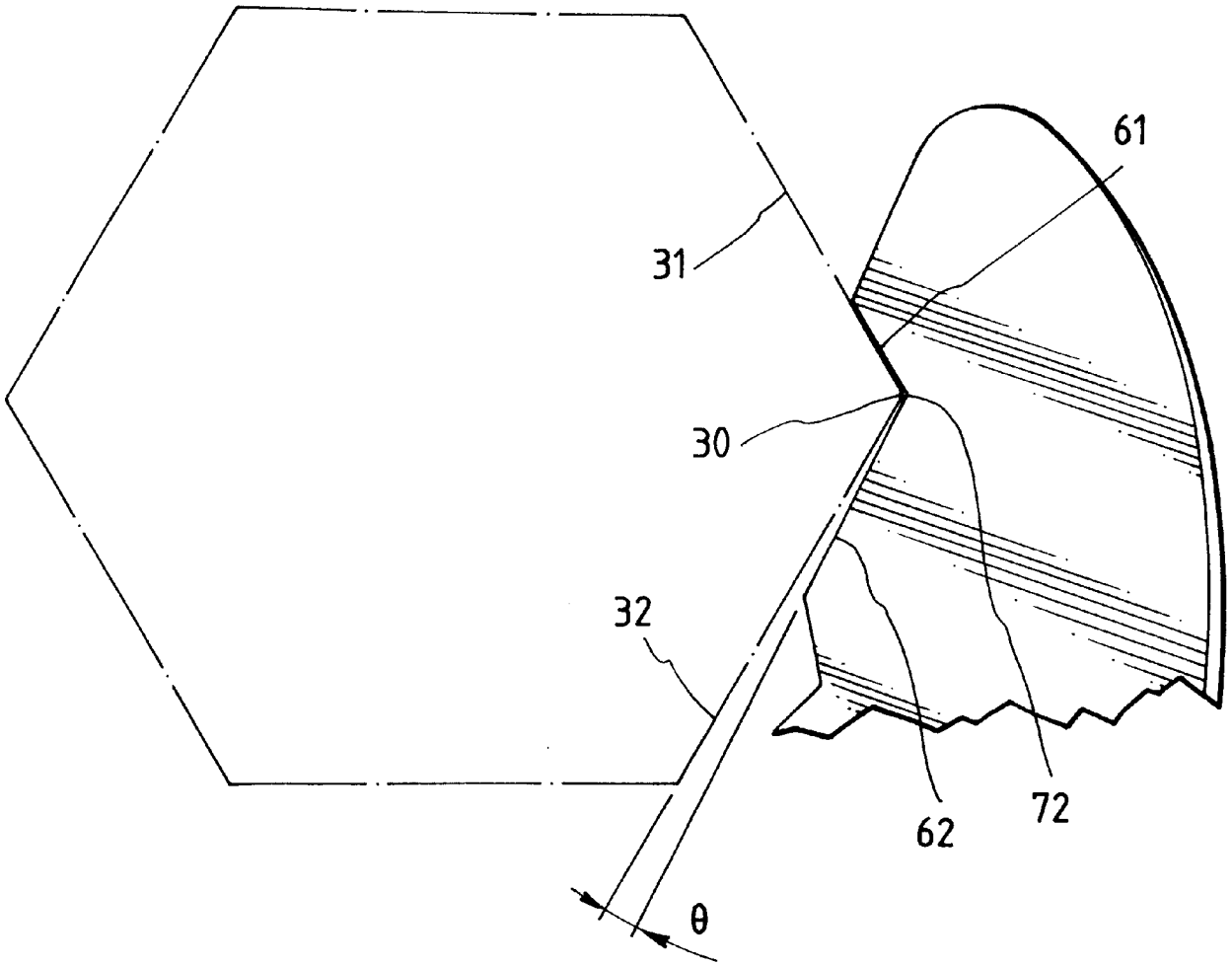
FIG. 8 is artial view of FIG. 6 for illustrating angle θ formed between one side of nut and a second interior surface at one arm of wrench

Referring to FIGS. 5 to 8, there is shown a head portion of an open end wrench constructed in accordance with the invention. The head of wrench comprises three projections 70, 71, and 72 at one arm 60 and three flats 51, 52, and 53 at the other opposite arm 50. Each of projections 70, 71, and 72 has a first interior surface 61 at one side and a second interior surface 62 at the other side. A first hexagonal nut (or bolt head) having a width WI engages with first flat 51 on arm 50 and first interior surface 61 of a first projection 70 on the other arm 60. Likewise, a second hexagonal nut (or bolt head) having a width W2 (larger than width W1) engages with second flat 52 on arm 50 and first interior surface 61 of a second projection 71 on the other arm 60 and a third hexagonal nut (or bolt head) having a width W3 (larger than width W2) engages with third flat 53 on arm 50 and first interior surface 61 of a third projection 72 on the other arm 60. In other words, the wrench is adapted to hold three different sized nuts (or bolt heads). As shown, one side and the other opposite side 31 of nut are held by one of flats 51, 52, and 53 and first interior surface 61 of wrench respectively. It is seen that the engagement area between nut and wrench is larger and symmetrical as compared with the prior art. Hence, the engagement is secure. Further, an angle θ with origin in third projection 72 (FIG. 8) is formed between one side 32 of nut and second interior surface 62 at one arm 60 of wrench. The provision of such small angle θ ensures torque to be completely transferred to nut while turning wrench. Hence, a slip between wrench and nut in operation as experienced in prior art is eliminated.

While the invention has been described by means of specific embodiments, numerous modifications and variations could be made thereto by those skilled in the art without departing from the scope and spirit of the invention set forth in the claims.

What is claimed is:

1. An open end wrench having a head comprising:

a first arm comprising a first, second, and third projections each having a first interior surface at one side and a second interior surface at said other side; and an opposite second arm comprising a first, second, and third flats;

wherein a first distance between said first flat and said first interior surface of said first projection is smaller than a second distance between said second flat and said first interior surface of said second projection, a third distance between said third flat and said first interior surface of said third projection is larger than said second distance between said second flat and said first interior surface of said second projection, and an angle θ is formed between one side of a held fastener and said second interior surface of one of said first, second, and third projections.

* * * * *